United States Patent [19]

Schröder et al.

[11] Patent Number: 4,655,325

[45] Date of Patent: Apr. 7, 1987

[54] METHOD AND APPARATUS FOR CONTROLLING ELEVATORS WITH DOUBLE CARS

[75] Inventors: Joris Schröder, Lucerne; Jiri Kiml, Balliwil; Fritz Meyer, Kussnacht, all of Switzerland

[73] Assignee: Inventio AG, Switzerland

[21] Appl. No.: 775,171

[22] Filed: Sep. 12, 1985

[30] Foreign Application Priority Data

Oct. 9, 1984 [CH] Switzerland ..... 04857/84

[51] Int. Cl.[4] ..... B66B 1/18

[52] U.S. Cl. ..... 187/127

[58] Field of Search ..... 187/29

[56] References Cited

U.S. PATENT DOCUMENTS 3,625,311 12/1971 Nowak ..... 187/29 R 4,582,173 4/1986 Schröder ..... 187/29 R

*Primary Examiner*—William M. Shoop, Jr.

*Assistant Examiner*—W. E. Duncanson, Jr.

*Attorney, Agent, or Firm*—Marshall & Melhorn

[57] ABSTRACT

An elevator control receives car calls for certain floors which are subject to a restriction of operation, but does not prevent the storage of these car calls. The car calls subject to the restriction of operation are only served during the trip in the opposite direction, if a load increase has been detected by a load measurement device during the change in the direction of travel. The restriction of operation is only cancelled during a predetermined time interval dependent on the movement of the car door and simultaneous occurrence of a load change caused by added travelers. Two storage cells are connected to the car call circuits for the car calls subject to the restriction of operation where an entered call, during a cancelled restriction of operation, is stored in the first storage cell and, during the restriction of operation, is stored in the second storage cell. A call stored in the first storage cell is transferred to the travel control of the elevator prior to the change of direction of travel and a call stored in the second storage cell is only transferred after the change of direction of the elevator.

24 Claims, 3 Drawing Figures

METHOD AND APPARATUS FOR CONTROLLING ELEVATORS WITH DOUBLE CARS

BACKGROUND OF THE INVENTION

The invention concerns a group control for elevators with double cars which are arranged in a common car frame to serve two adjacent floors. The car calls for trips to floors which are located in the direction of travel ahead of the car in question, are subject to a limitation of operation which differentiates between two call groups. The first call group comprises calls for odd numbered floors of the upper car and calls for even numbered floors of the lower car, and the second call group comprises calls for even numbered floors of the upper car and calls for odd numbered floors of the lower car. The limitation of operation can be cancelled under certain predetermined conditions.

U.S. Pat. No. 3,625,311 discloses a control for an elevator group with double cars arranged in such a way that two adjacent floors can be served simultaneously. Thus, the full occupation of a building should be attained in the shortest possible time with approximately uniform occupancy of the double cars. Passengers at the ground floor for even numbered floors enter the upper car and for odd numbered floors enter the lower car, where in each case the car call generation circuits for the floors not assigned to the car are blocked. As soon as the car has to stop for a floor call, the blocking is cancelled, so that an added passenger for any desired floor can travel in an upward direction. Likewise it is possible for travelers, who have entered the wrong car at the ground floor, to still travel to the desired floor by repeated operation of the car call generator circuit, whereby the objective to fully occupy the building in the shortest possible time can hardly be achieved.

This prior art elevator control is also slowed down when a traveler does not make use of the elevator called by him. A further disadvantage of this control is, that in case a traveler enters at a stop due to a car call without operating the floor call circuit, the blocking is not cancelled, so that the car will not stop at the desired floor. The above described control uses cold cathode tubes in its car call circuits, which at the same time serve as a car call register (or memory). The blocking of these car call circuits takes place by interruption of the plate voltage, whereby the storage of the car calls is prevented. The latter fact can be considered a disadvantage, as the calls have to be entered again after cancellation of the blocking action.

SUMMARY OF THE INVENTION

The present invention addresses the problem of how to fully occupy a building in the shortest possible time. The present invention accomplishes the objective and also permits added passengers the choice of the desired floor when the hall call circuit has not been operated.

It is the object of the invention to provide control equipment wherein the car call circuits operated during limited operation do not have to be operated a second time for a car call subject to the limitation of operation after cancellation of the limitation of operation. All car calls entered during a limitation of operation are stored in the car call memories where the car calls subject to the limitation of operation are only served on the immediately succeeding trip in the opposite direction if a load has been detected in the car at the change of direction of travel. The limitation of operation is only cancelled during a certain time interval, determined by the movement of the door and the simultaneous occurrence of a load change caused by an additional passenger. Two storage cells are assigned to the car call circuits for the car calls subject to the limitation of operation. A call entered during the time the limitation of operation is cancelled is stored in the first storage cell and a call entered during the limitation of operation is stored in the second storage cell. A call stored in the first storage cell is transferred to the travel control of the elevator prior to the change of direction of travel and a call stored in the second storage cell is transferred only after the change of direction of travel.

The advantages gained with the invention are that the stops caused by car calls subject to the limitation of operation can be reduced considerably, so that a shorter time to full occupancy can be achieved. Nevertheless, it is possible for added passengers to travel to any desired floor, even for which no floor call had been entered. Furthermore, it should be considered advantageous that the car call circuits actuated during the limited operation for the car calls subject to the limitation of operation, do not have to be operated a second time after cancellation of the limitation of operation. A further advantage can be achieved by being able to cancel such car calls while still at the main stopping station by a second actuation of the same car call circuit.

DESCRIPTION OF THE PREFERRED EMBODIMENT

Figure 1:
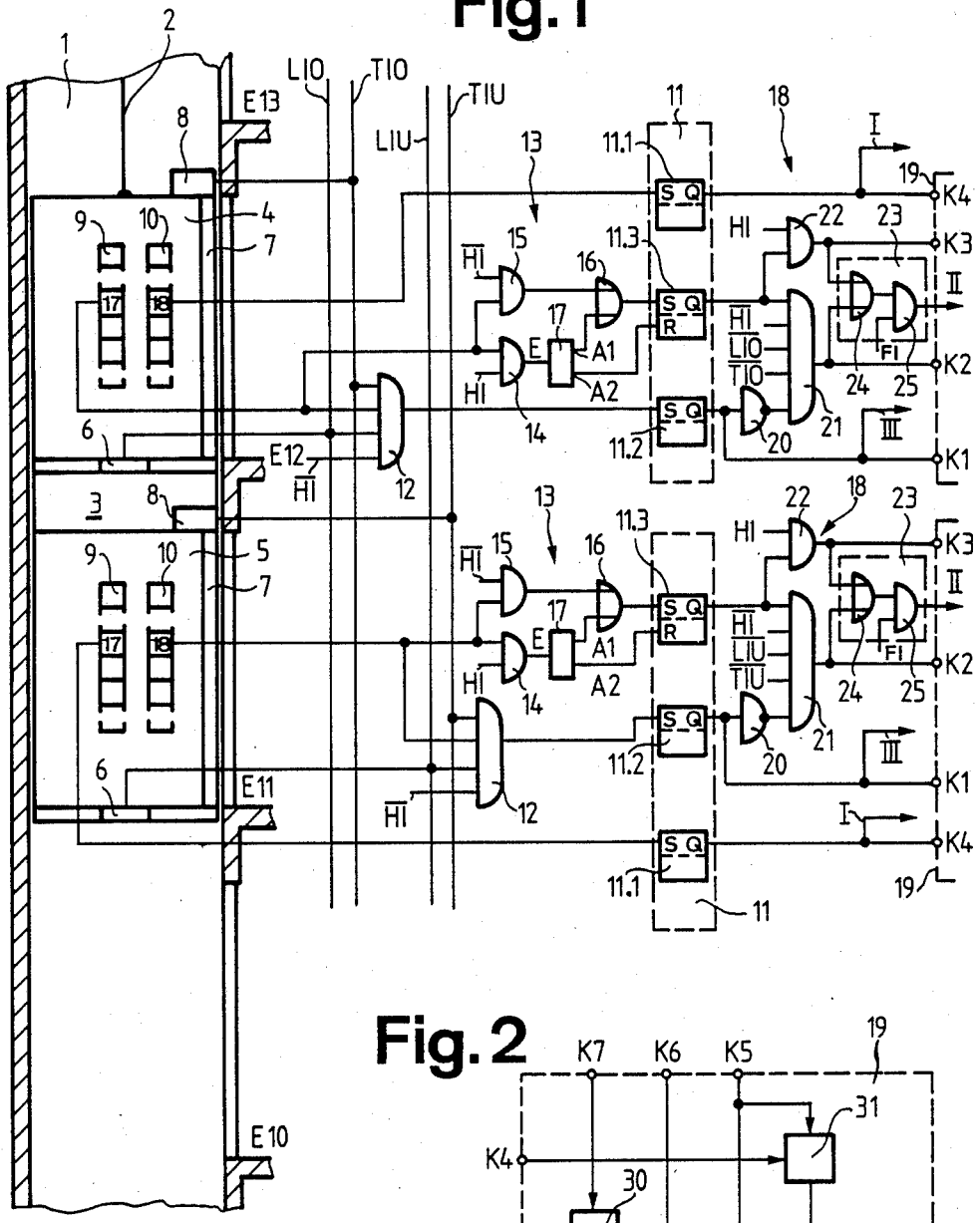
FIG. 1 is a schematic representation of a group control for elevators according to the present invention.

There is shown in FIG. 1 a part of an elevator shaft 1 comprising, for instance, four floors E10, Ell, E12 and E13 in which a double car 3, driven by a hoisting cable 2, is guided. The double car 3 is formed of two cars 4 and 5 built into a common cage, and which are arranged in such a way that their distance from each other corresponds to the distance of two neighboring floors. Each car 4 and 5 of the double car 3 includes a load measuring device 6, an automatically operatable door 7, with associated door control 8, car call circuit 9 for odd numbered floors, car call circuit 10 for even numbered floors and a car call register (or memory) 11. The car calls, which can be generated by means of the car call circuits 9 and 10, form two call groups. The first call group comprises calls for odd numbered floors of the upper car and calls for even numbered floors of the lower car, and the second call group consists of calls for even numbered floors of the upper car and calls for odd numbered floors of the lower car. Each of the two call groups can be made subject to a limitation of operation, which can become active on the upward and on the downward travel of the double car 3. In the following description, for instance, only the first call group is subject to a limitation of operation on the upward travel.

As shown in FIG. 1, the car call register 11 of the upper car 4 includes a storage cell 11.1 in each even numbered.car call circuit 10, and in each odd numbered car call circuit 9, a first storage cell 11.2 and a second storage cell 11.3. In the car call register 11 of the lower car 5, there are provided in odd numbered car call circuit 9 a storage cell 11.1, and in even numbered car call circuit 10 a first storage cell 11.2 and a second storage cell 11.3. Associated with each odd numbered car call circuit 9 of the upper car 4 and with each even numbered car call circuit 10 of the lower car 5, is a logical switching circuit 12, for example in the form of an AND-gate. The logical switching circuit 12 is connected on its input side with the respective car call circuit at one input, the door control 8 at a second input, as well as the load measuring device 6 of the respective cars 4 and 5 at a third input. On the output side, the logical switching circuit 12 is connected with the input S of the first storage cell 11.2 assigned to the respective car call circuit. The even numbered car call circuit 10 of the upper car 4 and the odd numbered car call circuit 9 of the lower car 5 are connected to the inputs S of the associated storage cells 11.1. A negated main stopping station signal $\overline{HI}$ can be connected to a fourth input of the logical switching circuits 12, which signal will always occur when the double car 3 is not located at a main stopping station. Other signals utilized in the description and drawing have the following meanings:

HI: main stopping station signal, occurs when the double car 3 is located at the main stopping station.

TIO,TIU: door signal of the upper car 4 and the lower car 5 respectively is generated on opening of the respective door 7 and, for instance, maintained for up to approximately two seconds after termination of the closing of the door.

$\overline{TIO}$,$\overline{TIU}$: the negations of the door signals.

LIO,LIU: load signal of the upper car 4 and the lower car 5 respectively is generated by a load change caused by added passengers.

$\overline{LIO}$,$\overline{LIU}$: the negations of the load signals.

EI: floor signal (FIG. 3), which occurs when the double car 3 approaches a stopping floor.

$\overline{EI}$: the negation of the floor signal.

FI: direction of travel signal for downward travel.

The odd numbered car call circuits 9 of the upper car 4 and the even numbered car call circuits 10 of the lower car 5 are connected in each case through a switching circuit 13 with the associated second storage cells 11.3 of the car call registers 11. The switching circuit 13 consists of two AND-gates 14 and 15 each having two inputs, an OR-gate 16 having two inputs, and a two bit counter 17, where one input of each of the AND-gates 14 and 15 is connected with the respective car call circuits. The other input of the AND-gate 14 is connected to the main stopping station signal HI and the other input of the AND-gate 15 is connected to the inverse signal $\overline{HI}$. The output of the AND-gate 15 is connected to one input of the OR-gate 16, whose output is connected with the set input S of the second storage cell 11.3. The output of the other AND-gate 14 is connected to the input E of the counter 17. The first output Al of the counter 17 is connected with the second input of the OR-gate 16 and the second output A2 of the counter is connected with the reset input R of the second storage cell 11.3.

The outputs Q of the first and second storage cells 11.2 and 11.3 are connected by way of a further switching circuit 18 with a car call signal circuit 19, which will be explained in more detail with the aid of FIG. 2. The switching circuit 18 consists of a NOT-gate 20, an AND-gate 21 having five inputs, and an AND-gate 22 with two inputs. The output Q of the first storage cell 11.2 is connected to a connection K1 of the car call signal circuit 19 and through the NOT-gate 20 to an input of the AND-gate 21. The output Q of the second storage cell 11.3 is connected with another input of the AND-gate 21 and an input of the AND-gate 22. The other input of the AND-gate 22 is connected to the main stopping station signal HI. The remaining inputs to the AND-gates 21 for the upper and lower cars are connected to the negated main stopping station signal $\overline{HI}$, the negated door signals $\overline{TIO}$ and $\overline{TIU}$ respectively and the negated load signals $\overline{LIO}$ and $\overline{LIU}$ respectively. The outputs of the AND-gates 21 and 22 are connected with the inputs K2 and K3 respectively of the car call signal circuit 19. The outputs Q of the storage cells 11.1 are connected with an input K4 of the respective car call signal circuits 19.

An inhibiting or blocking circuit 23 includes an OR-gate 24 having two inputs and an AND-gate 25 having two inputs. The inputs of the OR-gate 24 are connected with the outputs of the AND-gates 21 and 22 of the switching circuit 18. The output of the OR-gate 24 is connected to one input of the AND-gate 25 which has the other input connected to a direction of travel signal FI.

Figure 2:
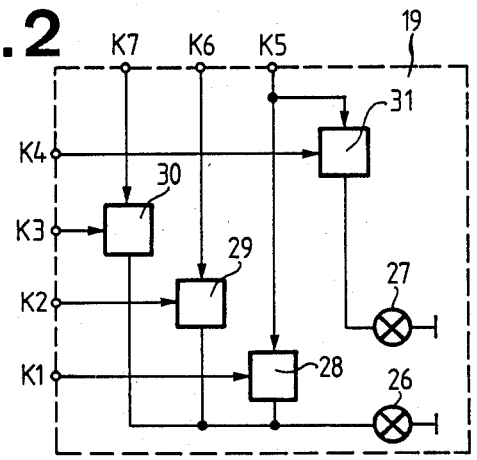
FIG. 2 is a schematic representation of a car call signalling circuit of the group control according to FIG. 1.

As shown in FIG. 2, the car call signal circuit 19 consists of two signal lights 26 and 27 and four power switching transistors 28, 29, 30 and 31. In the upper car 4, the signal lights 26 are assigned to the odd numbered car call circuits 9 and the signal lights 27 to the adjacent even numbered car call circuits 10. In the lower car 5, the signal lights 26 are assigned to the even numbered car call circuits 10 and the signal lights 27 to the adjacent odd numbered car call circuits 9. The signal light 26 is common to the output circuits of the power switching transistors 28, 29 and 30, while the signal light 27 is connected only in the output circuit of the power switching transistor 31. Designated with K5, K6 and K7 are further inputs, through which voltage is fed to the output circuits of the power switching transistors 28 through 31. The input circuits of the power switching transistors 28 through 31 are connected with the inputs K1 through K4, so that on input of a car call, the corresponding signal light 26 and 27 will light up. A nominal voltage is fed through the input K5 to cause the signal lights 26 and 27 to light normally. Only a part of the nominal voltage is applied to the input K6, so that the signal light 26 will glow weaker. The voltage fed through the input K7 is intermittent, so that the signal light 26 glows intermittently.

Figure 3:
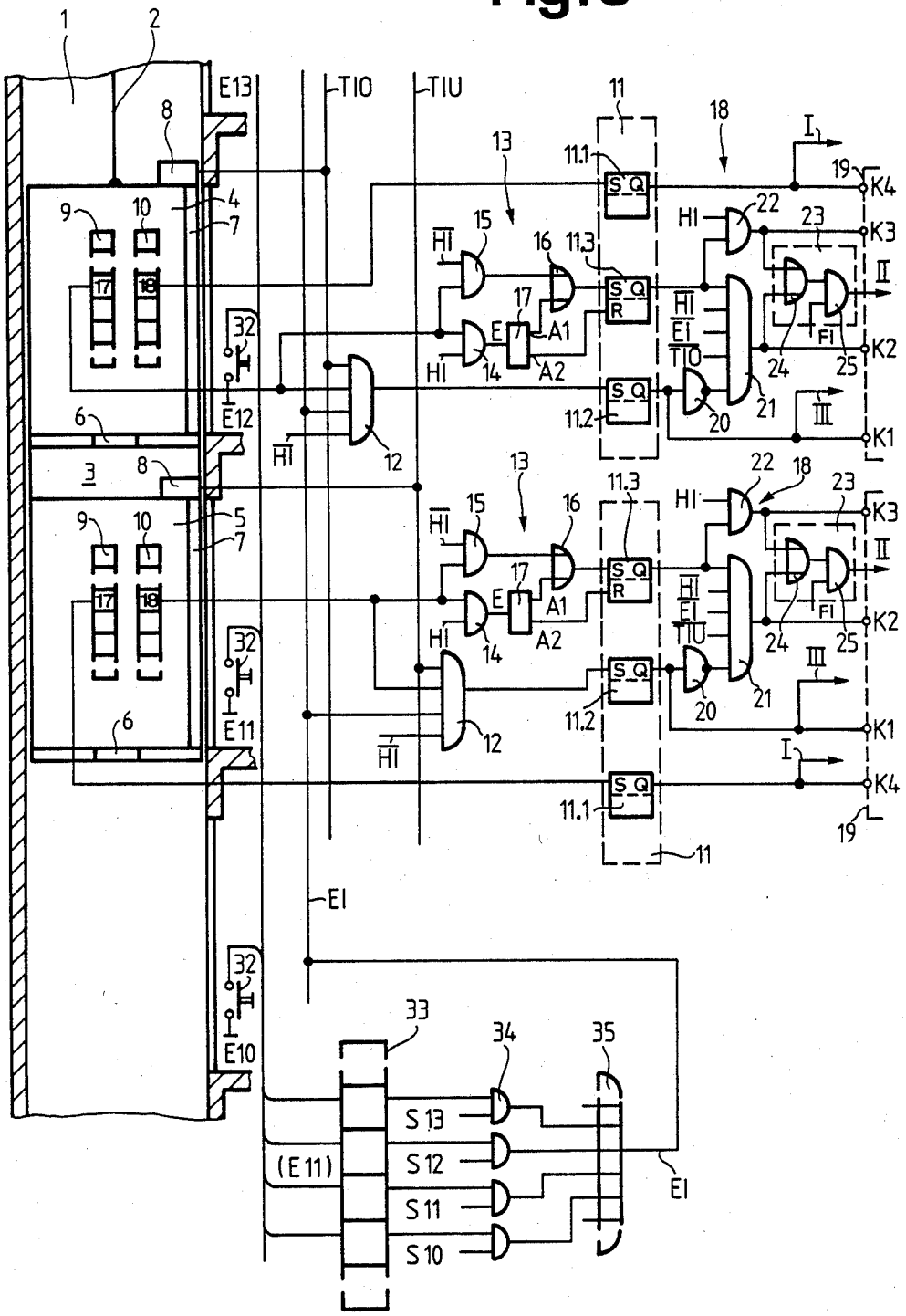
FIG. 3 is a schematic representation of a alternate embodiment of the group control according to FIG. 1.

As shown in FIG. 3, hall call circuits 32 are associated with the floors E10 through E13 and are connected with the inputs of a floor call register 33. Assigned to each storage cell of the floor call register 33 is an AND-gate 34 having two inputs, one input of which is connected with the output of the storage cell. The second inputs of the AND-gates 34 are connected with a selector (not shown) generating car position signals, where the car position signals, corresponding to the shown floors, are designated with S10 through S13. The outputs of the AND-gates 34 are connected to the inputs of an OR-gate 35, the output of which is connected with those inputs of the AND-gates 12 which, in the embodiment according to FIG. 1, are connected with the load measuring devices 6.

The control shown in FIGS. 1 and 2 operates as follows. On entering the main stopping station, which for instance might be located on the ground floor, the travelers are alerted by sign boards that the upper car 4 should be used for upward travel to even numbered floors and the lower car 5 for upward travel to odd numbered floors. Let it be assumed that a call for floor eighteen is entered in the upper car 4 through an even numbered car call circuit 10. That call is stored in the respective storage cell 11.1 of the car call memory 11 and is available without restriction to the travel control of the elevator (connection I, FIG. 1). Simultaneously the power switching transistor 31 is controlled through the input K4 so that the signal light 27 will glow normally, whereby the call is acknowledged as normally operable during the upward travel.

Furthermore, it shall be assumed, that a call for floor seventeen is entered in the upper car 4 by way of an odd numbered car call circuit 9. In so doing, the assigned second storage cell 11.3 of the car call register 11 is set by way of the AND-gate 14, the two bit counter 17 (output A1) and the OR-gate 16 enabled by the main stopping station signal HI. Simultaneously, the power switching transistor 30 is controlled by way of the AND-gate 22 and the input K3, so that the signal light 26 glows intermittently. By this means, the traveler is alerted that this call is subject to an operation restriction and can again be cancelled. The term "operation restriction" means that the call will only be serviced during the next following downward travel. The call existing at the output of the AND-gate 21 of the switching circuit 18 is inhibited during the upward travel by means of the inhibiting circuit 23. At the start of the downward travel and the appearance of the direction of travel signal FI, the stored call appears at the output of the AND-gate 25 of the inhibiting circuit 23 and is thus available without restriction to the travel control of the elevator (connection II, FIG. 1).

If the traveler has the intention to cancel this call while still in the main stopping station, the respective car call circuit 9 has to be actuated a second time. In doing so, the assigned second storage cell 11.3 of the car call circuit 11 is reset when enabled by the main stopping station signal HI by way of the AND-gate 14 and the two-bit counter 17 (output A2).

If the wrongly entered call has not been cancelled, the power switching transistor 29 is turned on after the beginning of the upward travel and in the presence of the negated main stopping station signal $\overline{HI}$, the negated door signal $\overline{TIO}$ and the negated load signal $\overline{LIO}$ at the AND-gate 21 and the input K2, so that the signal light 26 changes over from the intermittently glowing state into the faintly glowing state, and thereby likewise indicates the restriction of operation. The same effect is achieved, for instance, if the selected call for floor seventeen is only entered during the upward travel. However, the second storage cell 11.3 is set by the AND-gate 15 and the OR-gate 16. Before the calls subject to the restriction of operation are released for operation at the start of the downward travel, it is determined by load measurement whether there are still travelers present in the double car 3. If the measurement results fall below a minimum load, the calls stored in the second storage cells 11.3 are cancelled or erased.

On interruption of the upward travel due to a stop based on a car or floor call, the door signal TIO is generated by the opening of the door 7, for instance, of the upper car 4. Since the negated main stopping station signal $\overline{HI}$ is being generated, the entering of at least one traveler generates the load signal LIO and a car call can be entered through all AND-gates 12 assigned to the upper car 4. Now let it be assumed that a call is stored in the assigned storage cell 11.2 of the car call register 11 of the upper car 4 and is available to the travel control of the elevator without restriction (connection III, FIG. 1). Simultaneously the power switching transistor 28 is turned on through the input K1, so that the signal light 26 will glow normally, whereby the call is acknowledged as normally operable during the upward travel. If, as previously described, a call for floor seventeen is already entered at the main stopping station and the operating restriction for this call is indicated by faint glowing of the signal light 26, the voltage causing the faint flowing is switched off by way of the NOT-gate 20, the AND-gate 21, the input K-2 and the power switching transistor 29. Simultaneously the restricted operable call for floor seventeen disappears at the output of the AND-gate 21.

The control according to FIG. 3 works during a stop of the double car 3 at the main stopping station exactly as the control according to FIG. 1. During the upward travel however, the control described with the aid of FIG. 3 works in the following manner. It shall be assumed that a floor call was entered on floor E11 and that the double car 3 arrives during the upward travel with the lower car 5 on this floor. On coincidence of the stored floor call for floor E11 with the car position signal S11 generated by the selector, there occurs at the output of the OR-gate 35 the floor signal EI, which is connected to the AND-gate 12. When both the negated main stopping station signal $\overline{HI}$ and the door signal TIU are generated at the inputs of the AND-gates 12 assigned to the lower car 5, an unrestricted operable call can be entered through the even numbered car call circuits 10. On entering a car call, for instance for floor eighteen, the same events occur as during the input of a car call for floor seventeen in the upper car 4 as previously described. Instead of the floor signal EI, an operation direction signal can be connected to the AND-gate 12 and generated during a stop of the double car 3, whereby the same operation is achieved as was described in the preceding explanation.

In accordance with the provisions of the patent statutes, the principle and mode of operation of the present invention has been explained and illustrated in its preferred embodiments. However, it must be appreciated that the present invention can be practiced otherwise than as specifically explained and illustrated without departing from its spirit or scope.

What is claimed is:

1. A control system for the control of elevators with double cars, formed of two cars arranged in a common cage and serving in each case two adjacent floors, including car call circuits, a car call register, a load measuring device, an automatic door, and a door control circuit associated with each of the cars, where the car calls for travels to floors which lie in the direction of travel ahead of the car are subject to a restriction of operation which differentiates between two call groups, of which the first call group comprises calls for odd numbered floors of the upper car and calls for even numbered floors of the lower car, and the second call group comprises calls for even numbered floors of the upper car and calls for odd numbered floors of the lower car and where the restriction of operation can be cancelled, the control system comprising:

means responsive to car calls of both call groups entered through car call circuits for storing said car calls in car call registers during the restriction of operation, and means responsive to said stored calls of one of the two call groups and a load measuring device for stopping a car at the associated floors only when during a change in direction of travel of the car a load is detected by a load measuring device associated with the car.

2. A control system for the control of elevators with double cars, formed of two cars arranged in a common cage and serving in each case two adjacent floors, including car call circuits, a car call register, a load measuring device, an automatic door, and a door control circuit associated with each of the cars, where the car calls for travels to floors which lie in the direction of travel ahead of the car are subject to a restriction of operation which differentiates between two call groups, of which the first call group comprises calls for odd numbered floors of the upper car and calls for even numbered floors of the lower car, and the second call group comprises calls for even numbered floors of the upper car and calls for odd numbered floors of the lower car and where the restriction of operation can be cancelled, the control system comprising:

means responsive to car calls of both call groups entered through car call circuits for storing said car calls in car call registers during the restriction of operation, means responsive to said stored calls of one of the two call groups and a load measuring device for stopping a car at the associated floors only when during a change in direction of travel of the car a load is detected by a load measuring device associated with the car, and means for cancelling the restriction of operation during a predetermined time interval wherein the car calls of both call groups entered during said time interval are transferred to said means responsive to said stored calls prior to the change in direction of travel.

3. The control system according to claim 2 wherein said means for cancelling the restriction of operation operates shortly prior to the car reaching a stopping floor and re-establishes the restriction of operation shortly after departure of the car from the stopping floor.

4. The control system according to claim 3 wherein said means for cancelling the restriction of operation is connected to a door control circuit for the car and a predetermined time interval during which the restriction of operation is cancelled is dependent on the movement of an associated automatic door.

5. The control system according to claim 4 wherein the restriction of operation is cancelled with the opening of the automatic door and is re-established approximately two seconds after termination of the closing of the automatic door.

6. The control system according to claims 1 or 2 wherein each of the car call registers includes two storage cells which are assigned to the car call circuits of said one call group, wherein a car call entered during a predetermined time interval is stored in a first one of said storage cells and a car call entered outside the predetermined time interval is stored in a second one of said storage cells, and wherein a car call stored in said first storage cell is transferred to said means responsive to said stored calls prior to a change in direction of travel and a car call stored in said second storage cell is transferred to said means responsive to said stored calls after the change in direction of travel.

7. The control system according to claims 1 or 2 wherein said means for cancelling the restriction of operation is connected to a load measuring device for the car and the restriction of operation is cancelled during the predetermined time interval and the simultaneous occurrence of a load change caused by at least one added passenger.

8. The control system according to claim 2 wherein a logical switching circuit is connected to the car call circuits of said one call group, and has inputs at least connected with the respective car call circuit, the respective door control circuit and the respective load measuring device of the car and an output connected with a first storage cell, whereby during the predetermined time interval a stop is made and in response to the generation of a door signal by the door control circuit when the automatic door is open and the generation of a load signal by the load measuring device when a traveller enters the car, an entered car call is stored in said first storage cell.

9. The control system according to claims 2, 3, 4 or 5 wherein the restriction of operation during the predetermined time interval is cancelled at a stop for a floor call.

10. The control system according to claim 2 wherein a logical switching circuit is connected to the car call circuits of said one call group, and has inputs connected at least with the respective car call circuit, the respective door control circuit and a floor call register of the car, and an output connected to a first storage cell, whereby during the predetermined time interval a stop is made and in response to the generation of a door signal by the door control circuit when the automatic door is open and the generation of a floor signal by the floor call register, an entered car call is stored in the said storage cell.

11. The control system according to claim 10 wherein said logical switching circuit input connected to said floor call register is connected to an output of an OR-gate, wherein said floor call register has a storage cell for storing a hall call for each floor, an output of each said storage cell is connected to an input of an associated AND-gate having another input connected to a selector generating car position signals, wherein an output of each AND-gate is connected to an input of said OR-gate whereby at the coincidence of a stored floor call and a corresponding car position signal at one of said AND-gates, said OR-gate generates said floor signal to said logical switching circuit.

12. The control system according to claim 6 wherein said car call circuits of said one car call group are connected through switching circuits to said associated second storage cells, said switching circuits including a first AND-gate having an input connected to a source of a main stopping station signal, another input connected to an output of an associated one of said car call circuits and an output connected to an input of a two bit counter, said two bit counter having a first output connected to an input of an OR-gate and a second output connected to a reset input of an associated one of said second storage cells, a second AND-gate having an input connected to a source of a negated main stopping station signal, another input connected to said associated one of said car call circuits and an output connected to another input of said OR-gate, said OR-gate having an output connected to a set input of said second storage cell whereby when the car stops at the main stopping station and a car call is generated by said car call circuit, said car call sets said second storage cell, and upon repeated operation of said car call circuit, said second storage cell is alternately reset to cancel said car call and set to store said car call.

13. The control system according to claim 6 wherein outputs of said first and the second storage cells are connected through switching circuits to car call signal circuits, each said switching circuit including a NOT-gate, an AND-gate having five inputs and an AND-gate having two inputs, said output of said first storage cell being connected to a first input of said car call signal circuit and through said NOT-gate to an input of said AND-gate having five inputs, said output of said second storage cell is being connected to a second input of said AND-gate having five inputs and to an input of said other AND-gate, an output of said AND-gate having five inputs being connected to a second input of said car call signal circuit and an output of said other AND-gate being connected to a third input of said car call signal circuit, whereby during travel from the main stopping station a negated main stopping station signal, a negated door signal and a negated load signal are generated to remaining inputs of said AND-gate having five inputs, and a main stopping station signal is connected to another input of said other AND-gate during a stop at the main stopping station.

14. The control system according to claim 13 wherein the car call signal circuit has at least three power switching transistors each having an output, a signal light common to all outputs of said power switching transistors, a fifth input connected to a source of nominal voltage, a sixth input connected to a source of a part of the nominal voltage, and a seventh input connected to a source of intermittent voltage, a first input of each of the three power switching transistors connected with said first, second and third inputs of the car call signal circuit respectively, a second input of each of the three power switching transistors connected with said fifth, sixth and seventh inputs of said car call signal circuit respectively, whereby for a call stored in said first storage cell said signal light will light normally, for a call stored in said second storage cell during the travel from the main stopping station said signal light will glow fainter and for a call stored in said second storage cell during a stop at the main stopping station said signal light will glow intermittently.

15. The control system according to claim 13 including an inhibiting circuit having an OR-gate having two inputs and an AND-gate having two inputs, each input of said OR-gate being connected with a respective output of one of said AND-gates of said switching circuit and an output of said OR-gate being connected to an input of said AND-gate of said inhibiting circuit, and a source of a direction of travel signal connected to the other input of said inhibiting circuit AND-gate, whereby a call stored in said second storage cell becomes available at an output of said inhibiting circuit AND-gate for the travel control of the elevator only after the change in the direction of travel, and whereby a call stored in said first storage cell becomes available for the travel control of the elevator directly at an output of said first storage cell prior to the change in the direction of travel.

16. The control system according to claim 6 wherein a call stored in said second storage cell is cancelled, if at a change in the direction of travel the load in the car as detected by a load measuring device is less than a predetermined minimum load.

17. The control system according to claims 8 or 10 wherein the logical switching circuit is an AND-gate having said inputs and said output.

18. The control system according to claim 1 wherein said one call group is the first call group, which comprises calls for odd numbered floors of the upper car and calls for even numbered floors of the lower car.

19. A control system for an elevator with double cars serving adjacent floors, each car having car call circuits, a car call register, a load measuring device, an automatic door, and a door control circuit associated with it, where car calls for floors in the direction of travel ahead of the car are subject to a restriction of operation which differentiates between at least two call groups, the control system comprising:

storage means connected to car call circuits for storing entered car calls during a restriction of operation;

means responsive to said stored car calls for stopping a car at an associated floor; and means for transferring stored car calls of a first one of said two call groups during said restriction of operation from said storage means to said means for stopping and for transferring stored car calls of a second one of said two call groups from said storage means to said means for stopping only during a cancellation of said restriction of operation.

20. The control system according to claim 19 including a switching circuit connected to an input to the car call circuits associated with said second one of said two call groups, at another input to a source of an enabling signal, and at an output to said storage means; and an inhibiting circuit connected at an input to an output of said storage means, at another input to a source of a signal representing a change in the direction of travel of the car, and at an output to said means for stopping whereby when said enabling signal is generated, a car call of said second call group is stored in said storage means and when said change of direction signal is generated, said stored car call is transferred to said means for stopping.

21. The control system according to claim 20 wherein said enabling signal is generated in response to the position of the car with respect to a main stopping station.

22. A control system for an elevator with double cars serving adjacent floors, each car having car call circuits for generating car calls, a car call register, an automatic door, and a door control circuit, the car calls being separated into at least two groups, one group being subject to a restriction of operation, the control system comprising:

a first and a second storage cell in the car call register, each storage cell having an input and an output;

a first switching circuit connected between the car call circuits of said one group and said input of said second storage cell whereby a car call is stored in said second storage cell;

a second switching circuit having an input connected to said output of said second storage cell and having an output; and an inhibiting circuit having an input connected to said output of said second switching circuit and an output connected to a travel control for the cars and being responsive to a change in the direction of travel of the cars for transferring a car call stored in said second storage cell to said travel control during a change in the direction of travel of the car.

23. The control system according to claim 22 including a logical switching circuit having inputs connected to the car call circuits of said one group, to the door control circuit, and to a source of a load change signal and having an output connected to an input of said first storage cell, said first storage cell having an output connected to another input of said second switching circuit and to said travel control, whereby when the automatic door is open and the load in the car changes, a car call of said one group is stored in said first storage cell, is transferred to said travel control, and disables said second switching circuit.

24. The control system according to claim 22 including a logical switching circuit having inputs connected to the car call circuits of said one group, to the door control circuit, and to a source of floor signal representing the coincidence of a floor call and a car position signal for the same floor and having an output connected to an input of said first storage cell, said first storage cell having an output connected to another input of said second switching circuit and to said travel control, whereby when the automatic door is open and the floor signal is generated, a car call of said one group is stored in said first storage cell, is transferred to said travel control, and disables said second switching circuit.

* * * * *